US009387486B2

(12) United States Patent
Cheng et al.

(10) Patent No.: US 9,387,486 B2
(45) Date of Patent: Jul. 12, 2016

(54) HIGH-GRADIENT PERMANENT MAGNET APPARATUS AND ITS USE IN PARTICLE COLLECTION

(71) Applicant: UT-Battelle, LLC, Oak Ridge, TN (US)

(72) Inventors: Mengdawn Cheng, Oak Ridge, TN (US); Gerard Michael Ludtka, Oak Ridge, TN (US); Larry R. Avens, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 14/867,768

(22) Filed: Sep. 28, 2015

(65) Prior Publication Data

US 2016/0089677 A1 Mar. 31, 2016

Related U.S. Application Data

(60) Provisional application No. 62/057,295, filed on Sep. 30, 2014.

(51) Int. Cl.

| | |
|---|---|
| ***B03C 1/031*** | (2006.01) |
| ***B03C 1/02*** | (2006.01) |
| *B03C 1/025* | (2006.01) |

(52) U.S. Cl.

CPC . *B03C 1/02* (2013.01); *B03C 1/031* (2013.01); *B03C 1/025* (2013.01)

(58) Field of Classification Search

CPC ..... B03C 1/002; B03C 1/025; B03C 1/031; B03C 1/033; B03C 1/0332; B03C 2201/18; B03C 2201/20; B03C 1/032; B03C 1/034

See application file for complete search history.

(56) References Cited

U.S. PATENT DOCUMENTS 3,567,026 A * 3/1971 Kolm ..... B03C 1/24 210/222
3,770,629 A * 11/1973 Nolan ..... B03C 1/025 209/232

(Continued)

FOREIGN PATENT DOCUMENTS

CN 1128023 C 11/2003
CN 101069872 A 11/2007

(Continued)

OTHER PUBLICATIONS

Teste, B. et al., "Magnetic core shell nanoparticles trapping in a microdevice generating high magnetic gradient", Lab Chip, (2011), vol. 11, pp. 833-840.

*Primary Examiner* — Joseph C Rodriguez
(74) *Attorney, Agent, or Firm* — Scully, Scott, Murphy & Presser, P.C.

(57) ABSTRACT

A high-gradient permanent magnet apparatus for capturing paramagnetic particles, the apparatus comprising: (i) at least two permanent magnets positioned with like poles facing each other; (ii) a ferromagnetic spacer separating the like poles; and (iii) a magnetizable porous filling material in close proximity to the at least two permanent magnets. Also described is a method for capturing paramagnetic particles in which a gas or liquid sample containing the paramagnetic particles is contacted with the high-gradient permanent magnet apparatus described above; wherein, during the contacting step, the gas or liquid sample contacts the magnetizable porous filling material of the high-gradient permanent magnet apparatus, and at least a portion of the paramagnetic particles in the gas or liquid sample is captured on the magnetizable porous filling material.

26 Claims, 5 Drawing Sheets

(56) References Cited

U.S. PATENT DOCUMENTS

| | | | | |
|---|---|---|---|---|
| 3,809,239 | A * | 5/1974 | Barrett | B03C 1/22 209/223.2 |
| 4,025,432 | A * | 5/1977 | Nolan | G05D 7/0186 138/42 |
| 4,772,383 | A * | 9/1988 | Christensen | B03C 1/0332 209/223.1 |
| 5,538,701 | A * | 7/1996 | Avens | C01G 56/004 209/8 |
| 6,159,378 | A * | 12/2000 | Holman | B03C 1/034 209/223.1 |
| 6,451,207 | B1 * | 9/2002 | Sterman | H01F 7/0278 210/222 |
| 7,056,657 | B2 * | 6/2006 | Terstappen | B03C 1/0332 209/214 |
| 7,223,345 | B2 | 5/2007 | Franzreb et al. | |
| 7,326,350 | B2 * | 2/2008 | Mueller | B03C 1/035 210/222 |
| 7,535,329 | B2 * | 5/2009 | Gorshkov | G01R 33/3806 335/296 |
| 9,227,199 | B2 * | 1/2016 | Ellis | B03C 1/288 |
| 2004/0159612 | A1 * | 8/2004 | Franzreb | B03C 1/0332 210/695 |
| 2010/0300978 | A1 * | 12/2010 | Ramadan | B03C 1/0332 210/695 |
| 2012/0255913 | A1 * | 10/2012 | Tung | B03C 1/0332 210/695 |
| 2014/0339138 | A1 * | 11/2014 | Koslow | B03C 1/0332 209/3 |
| 2015/0068964 | A1 * | 3/2015 | McAllorum | B03C 1/0332 210/223 |

FOREIGN PATENT DOCUMENTS

| | | | |
|---|---|---|---|
| CN | 101269351 | A | 9/2008 |
| CN | 101722102 | B | 1/2012 |
| CN | 102327810 | A | 1/2012 |
| JP | 2010-42367 | A | 2/2010 |

* cited by examiner

HIGH-GRADIENT PERMANENT MAGNET APPARATUS AND ITS USE IN PARTICLE COLLECTION

The present application claims benefit of U.S. Provisional Application No. 62/057,295, filed on Sep. 30, 2014, all of the contents of which are incorporated herein by reference.

This invention was made with government support under Prime Contract No. DE-AC05-00OR22725 awarded by the U.S. Department of Energy. The government has certain rights in the invention.

FIELD OF THE INVENTION

The present invention relates, generally, to methods for airborne or waterborne particle collection, and more particularly, to such methods in which a magnetic field is employed.

BACKGROUND OF THE INVENTION

Human exposure to particulate pollutants having a size below 10 μm, particularly those below 0.1 μm, has been strongly associated with adverse health effects due to their ability to be inhaled deeply into the respiratory system. A large number of particle collectors are commercially available for monitoring ambient air quality, worker health and safety, process manufacturing, and so forth. The U.S. Environmental Protection Agency has established an extensive network of samplers that routinely collect ambient particles for monitoring air quality and compliance to the National Ambient Air Quality Standards.

Particle collectors based on electromagnets have been used, but a significant drawback is the requirement of a power source. Although particle collectors based on permanent magnets are also known, they generally exhibit less than desirable collection efficiencies for particles having very small particle sizes of less than 100 nm, which are often the most important types of particles to collect in view of their particularly adverse health effects.

SUMMARY OF THE INVENTION

In one aspect, the instant disclosure is directed to a high-gradient permanent magnet apparatus (i.e., "high-gradient permanent magnet separator," or "HGPMS") for capturing paramagnetic particles of various sizes, particularly particles of nanoscopic size of up to 300 nm. The HGPMS device is particularly useful in capturing paramagnetic particles of up to or less than 200 nm, as commonly found in air and water environments. The HGPMS device described herein accomplishes this by including (i) at least two permanent magnets positioned with like poles facing each other; (ii) a ferromagnetic spacer separating the like poles; and (iii) a magnetizable porous filling material in close proximity to the at least two permanent magnets. In a further embodiment, the HGPMS includes (i) at least three permanent magnets positioned with like poles facing each other; (ii) a ferromagnetic spacer separating each pair of like poles; and (iii) a magnetizable porous filling material in close proximity to the at least three permanent magnets. The HGPMS device may also include (iv) a casing enclosing the elements (i), (ii), and (iii), wherein the casing contains an entry port and an exit port for the entry and exit, respectively, of a gas or liquid sample. The casing may be constructed of a ferromagnetic or non-ferromagnetic material.

In another aspect, the instant disclosure is directed to a method for capturing paramagnetic particles by use of the above-described HGPMS device. In the method, a gas or liquid sample containing the paramagnetic particles is contacted with the HGPMS device in such a manner that, during the contacting step, the gas or liquid sample contacts the magnetizable porous filling material (component iii) of the HGPMS device, and at least a portion of the paramagnetic particles in the gas or liquid sample is captured on the magnetizable porous filling material. The gas or liquid sample can be contacted with the HGPMS device by either passive sampling or active sampling, wherein passive sampling relies on passive flow (i.e., without employing a means for inducing flow) and active sampling relies on active flow, as provided by a means for inducing flow (e.g., a pump or fan).

DETAILED DESCRIPTION OF THE INVENTION

Figure 1:
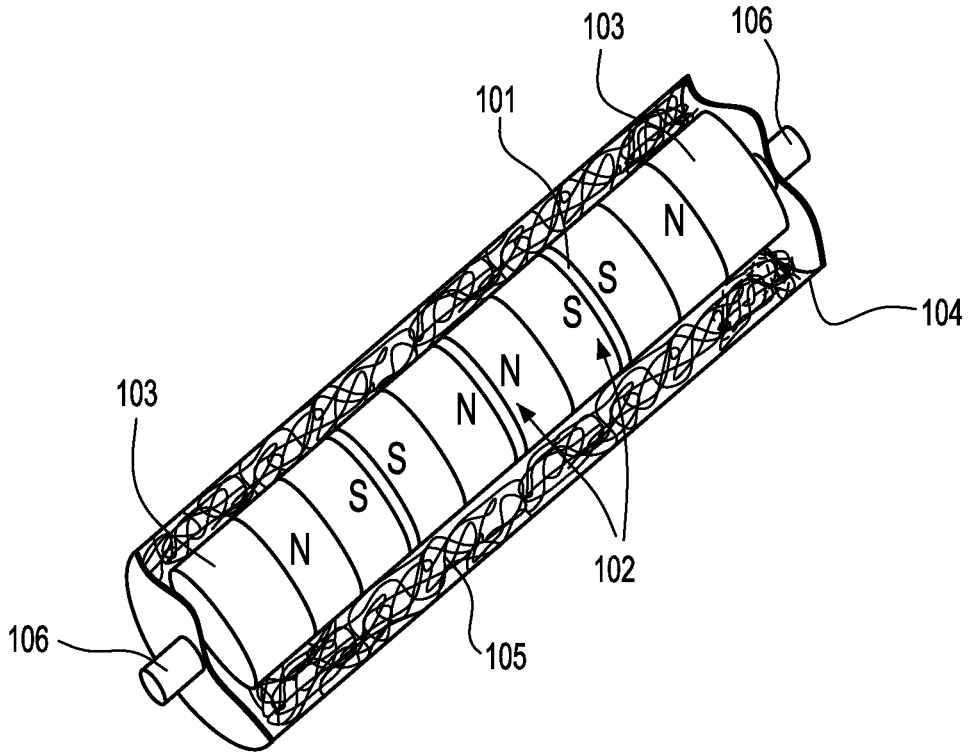
FIG. 1. A depiction of a HGPMS device containing a linear arrangement of four permanent magnets with three pairs of like poles facing each other, each pair of like poles separated by a ferromagnetic separator.

Referring to FIG. 1, the HGPMS device includes (i) at least two permanent magnets 102 (hereinafter also referred to as "magnets") positioned with like poles facing each other; (ii) a ferromagnetic spacer 101 separating the like poles; and (iii) a magnetizable porous filling material 105 in close proximity to the at least two permanent magnets. The term "like poles" is understood to mean "two or more north magnetic poles" or "two or more south magnetic poles." The term "facing," as used herein, includes any sufficiently close arrangement that permits the two or more like magnetic fields emanating from like poles to overlap or interact. Thus, the term "facing" includes the possibility of the like poles being linearly opposed (i.e., two like poles precisely or approximately 180 degrees from each other) and the possibility of the like poles being adjacent to each other in a non-linear (i.e., angled or bent) manner provided that the magnets (at the like poles) are not in direct contact, i.e., separated by a ferromagnetic separator. When the magnets are positioned linearly, each pair of like poles necessarily contains two like poles facing each other and separated by a ferromagnetic separator.

The number of permanent magnets is at least two, and may be at least three, four, five, six, seven, eight, nine, ten, or a higher number of such permanent magnets, wherein the magnets are arranged with like poles facing each other and with each pair of like poles separated by a ferromagnetic separator. In the case of two permanent magnets arranged linearly, the ferromagnetic separator separates one pair of like poles. In the case of three permanent magnets arranged linearly, a ferromagnetic separator separates like poles in each of two pairs of like poles. FIG. 1 shows an exemplary HGPMS device that contains four permanent magnets with like poles facing each other in a linear arrangement. As shown, the four permanent magnets result in three pairs of like poles facing each other, each pair separated by a ferromagnetic separator, such as iron.

The foregoing examples all reflect a linear arrangement of the magnets; however, the permanent magnets need not be arranged linearly. For example, the magnets may, in some embodiments, be arranged in a curved (e.g., horseshoe) or circular arrangement. In a circular arrangement containing two magnets, each magnet may be curved with two pairs of like poles facing each other (each pair separated by a ferromagnetic spacer) to form a circular pattern. The magnets may also be arranged in a non-planar (i.e., branching or three-dimensional) pattern, such as an arrangement in which a third curved magnet is incorporated into the circular arrangement described above to result in two sets of three like poles, with the three like poles in each set separated from each other by a ferromagnetic separator. Thus, the term "pair," when used herein, also includes the possibility of a "set" (i.e., more than two) of like poles separated from each other by a ferromagnetic separator. In a set of three like poles, the three like poles may be separated by a triangular-shaped ferromagnetic separator in which each face of the triangular-shaped ferromagnetic separator is in contact with a like pole. In a particular embodiment, three linear magnets are arranged with three like poles converging on a triangular-shaped ferromagnetic separator, in which case the HGPMS device contains a single set of three like poles facing each other and separated by a ferromagnetic separator.

The permanent magnets (i.e., "magnets") can be any of the permanent magnets known in the art. As understood in the art, a permanent magnet is any material that possesses its own persistent magnetic field. Thus, the permanent magnet described herein is not an electromagnet since the permanent magnet does not need an electric current to produce its magnetic field. Typically, the permanent magnet is metallic, and generally contains at least one element selected from iron, cobalt, nickel, and rare earth elements, wherein the rare earth elements are generally understood to be any of the fifteen lanthanide elements along with scandium and yttrium. In some particular embodiments, the permanent magnet includes iron, such as magnetite, lodestone, or alnico. In other particular embodiments, the permanent magnet contains at least one rare earth element, particularly samarium and/or neodymium. A particularly well-known samarium-based permanent magnet is the samarium-cobalt (Sm—Co alloy) type of magnet. A particularly well-known neodymium-based permanent magnet is the neodymium-iron-boron (Nd—Fe—B) type of magnet. The permanent magnet may also be a rare-earth-free type of magnet, such as a Hf—Co or Zr—Co alloy type of permanent magnet, such as described in Balamurugan et al., *Journal of Physics: Condensed Matter*, vol. 26, no. 6, 2014, the contents of which are herein incorporated by reference in their entirety.

The ferromagnetic separator is constructed of any of the materials known in the art that are hard durable solids and are magnetizable, i.e., exhibit an induced magnetism for a period of time after being exposed to a magnetic field, typically exhibited as a hysteresis, but generally do not exhibit their own appreciable persistent magnetic field. The ferromagnetic separator may exhibit a weak persistent magnetism before or during use in the HGPMS device, but the weak persistent magnetism, if present, is significantly lower (e.g., no more than 1, 5, or 10%) than what is provided by the permanent magnets. For the instant purposes, the ferromagnetic separator is generally metallic, either as a single metal or an alloy. However, in some cases, the ferromagnetic separator can have a ceramic (generally, metal oxide) type of composition. In some embodiments, the ferromagnetic separator is iron-based, which may be predominantly or completely made of iron, such as iron itself or a ferromagnetic grade of steel, such as a 400 series type of steel. The ferromagnetic separator may alternatively be, for example, based on or include cobalt, nickel, or one or more rare earth elements, or an oxide thereof.

The HGPMS device also includes a magnetizable porous filling material in close proximity to the at least two permanent magnets. The term "close proximity," as used herein, corresponds to a sufficiently close distance to the magnets such that the magnetizable porous filling material is magnetically influenced by the magnets. Typically, to be in "close proximity," the magnetizable porous filling material is within 1 or 2 centimeters, or in at least partial contact with the magnets and/or the ferromagnetic separator(s). In some embodiments, the magnetizable porous filling material partially or completely surrounds the permanent magnets, and/or at least partially or completely surrounds the portion(s) of the magnets where like poles are facing each other (or partially or completely surrounds the one or more ferromagnetic spacers). The pores of the magnetizable porous filling material should be of sufficient size to permit the unimpeded flow of a gas or liquid. Typically, a pore size of at least or above 50, 100, 200, or 500 microns (or a pore size in a range therebetween) and up to or less than 1 or 2 millimeters is particularly suitable. In some embodiments, the magnetizable porous filling material is a non-fibrous solid material that possesses pores. In other embodiments, the magnetizable porous filling material is a fibrous (e.g., mesh, wool, or woven or non-woven fabric) material with pores created by the entanglement and overlap of fiber strands.

The magnetizable porous filling material can be any solid material known in the art that is both magnetizable and porous. Preferably, the magnetizable porous filling material is not substantially prone to oxidation or other degradation in the presence of air or water. The magnetizable porous filling material can be, for example, a porous (for example, fibrous) version of any of the ferromagnetic substances described above, such as an iron-, cobalt-, or nickel-containing wool, mesh, or fabric. In a particular embodiment, the magnetizable porous filling material is a steel (generally stainless steel) wool, particularly a ferromagnetic steel (generally stainless steel) wool, such as a 400 series stainless steel wool. In the case of a fibrous filling material, the individual fibers can have a diameter of, for example, up to or less than 500, 200, 100, 50, 20, or 10 microns, or a range therein. The porosity is typically at least or above 0.5, and more typically at least or above 0.6, 0.7, 0.8, 0.9, or 0.95.

Further referring to FIG. 1, the HGPMS device may also include a casing 104 (iv) that at least partially or completely encloses the magnetic assembly, wherein the term "magnetic assembly" herein refers to components (i)-(iii) described above. The casing can be any solid material that can function in a protective capacity and/or to keep the magnetizable porous filling material and magnets in compact form and in close proximity with each other. The casing can be ferromagnetic or non-ferromagnetic, and metallic or non-metallic. In the case of a non-metallic casing, the casing may be constructed of, for example, a plastic or a ceramic. In the case of a ferromagnetic casing, any of the solid durable ferromagnetic materials, such as those described above, can be used. In the case of a non-ferromagnetic material, the casing can be made of any material that possesses a weak or undetectable level of ferromagnetism (as compared to, for example, iron, nickel, or cobalt). Some such non-ferromagnetic materials include, for example, austenistic (300 series) or ferritic types of stainless steel, aluminum, zinc, or an alloy or oxide thereof, and plastics and ceramics. The casing may also include two or more end caps 103, which can be constructed of the same or different material as the casing. The end caps generally function to cover entry and exit ports 106 for gas and liquid samples to enter and exit the magnetic assembly, respectively. The end caps may also function to retain the magnetic assembly when closed and permit the removal and replacement of the magnetic assembly when opened.

Generally, the casing includes at least one entry port and one exit port for gaseous or liquid samples to enter and exit, respectively, the area occupied by the magnetic assembly to make contact with at least the magnetizable porous filling material in the magnetic assembly. In some embodiments, the casing includes at least one entry port specifically designed for gas or liquid to enter, e.g., at one end of the HGPMS device where gas or liquid enters by a flowing force, along with at least one exit port at another end of the HGPMS device where gas or liquid exits by the same flowing force. In other embodiments, the casing includes two or more ports (e.g., a multiplicity of ports), each of which may alternatively be useful for entry or exit of a gas or liquid. In some embodiments, the ports may be fitted with lids, stoppers, or plugs to control the entry and exit of gas or liquid. In some embodiments, the casing does not include an entry and exit port, but instead surrounds the entire magnetic assembly except for a single opening that permits the magnetic assembly to be partially or completely removed for sampling a gas or liquid.

The HGPMS device may or may not also include active flowing means to ensure flow of a gas or liquid sample into the area occupied by the magnetic assembly. The active flowing means may be attached (e.g., permanently or reversibly) or not attached to the magnetic assembly or casing. Without an active flowing means, the HGPMS device relies on passive flow of the gas or liquid sample into the area occupied by the magnetic assembly. The active flowing means can be any device known in the art that causes a gas or liquid to flow. Some examples of active flowing means include a pump, fan, or propeller, or alternatively, a motorized or non-motorized vehicle on which the HGPMS device is mounted, wherein mechanized or non-mechanized movement of the vehicle results in flow of the gas or liquid that the vehicle traverses. In some embodiments, the active flow means may further include means for adjusting the flow rate to a flow rate that provides a more optimal or desired level of particle collection efficiency. The flow adjusting means can be any such means in the art, such as a switch or dial that permits a variable mechanical speed in a pump, fan, or propeller, or by adjusting the speed of a vehicle on which the HGPMS device is mounted. Alternatively, entry and/or exit ports on the casing, if present, could be fitted with an overlapping feature that can be suitably adjusted in overlap with the port to adjust the amount the port is opened, thereby indirectly adjusting the flow rate.

In another aspect, the invention is directed to a method for capturing paramagnetic particles by contacting a gas or liquid sample containing such paramagnetic particles with the region occupied by the magnetic assembly in the HGPMS device described above. More particularly, the gas or liquid sample should at least contact the magnetizable porous filling material of the HGPMS device, since the magnetizable porous filling material is the primary component that captures the paramagnetic particles. In the method, at least a portion of the paramagnetic particles in the gas or liquid sample is captured on the magnetizable porous filling material. In one embodiment, the HGPMS device is operated in a passive sampling mode, which relies on passive flow of the gas or liquid to contact the magnetic assembly of the HGPMS device. For example, a HGPMS device without a casing, or with magnetic assembly partially enclosed in a casing, or with magnetic assembly fully enclosed in a casing that includes one or more entry ports and one or more exit ports, may be placed in a space occupied by a gas or a liquid, wherein the natural flow or diffusion of the gas or liquid is relied upon for establishing contact between the gas or liquid sample and magnetic assembly. In another embodiment, the HGPMS device is operated in an active sampling mode, which relies on active flow of the gas or liquid to contact the gas or liquid with the magnetic assembly of the HGPMS device. The active flow is established by any suitable active flowing means, such as any such means described above. In some embodiments, the active flowing means is manipulated to adjust the flow rate to a flow rate that provides a more optimal or desired level of collection efficiency, such as a flow rate of at least, above, up to, or less than, for example, 1, 2, 5, 8, 10, 12, 15, 18, or 20 cm/s, which generally correspond to between about 0.4 or 0.5 to about 8, 9, or 10 LPM.

The paramagnetic particles being captured generally refer to particles of a nanoscopic size (e.g., up to or less than 300 nm, 200 nm, 100 nm, 80 nm, 60 nm, or 50 nm) that contain at least one element having a paramagnetic property, i.e., "paramagnetic element" (i.e., element attracted to a magnetic field) either as an inherent property of the element or as induced in the element by its surrounding environment. In some embodiments, the paramagnetic particles have a size of at least or above 10, 20, 30, 40, or 50 nm and up to or less than 80, 90, 100, 120, 150, or 200 nm, or a size within a range between any two of any of the foregoing values. The term "paramagnetic," as used herein, also includes that the element containing a paramagnetic property can be ferromagnetic or ferrimagnetic. The paramagnetic particles may be constructed of one or more paramagnetic elements in their elemental (zerovalent) state, or one or more paramagnetic elements in the form of one or more compounds (e.g., metal oxides, metal hydroxides, or metal sulfides).

Numerous elements are either inherently paramagnetic or can be induced to exhibit paramagnetic behavior. The one or more paramagnetic elements can be, for example, an alkali element (Group 1 of the Periodic Table), alkaline earth element (Group 2 of the Periodic Table), transition element (e.g., Groups 3-11 of the Periodic Table), main group element (e.g., Groups 13-16 of the Periodic Table), lanthanide element, or actinide element. Some examples of alkali elements that can exhibit paramagnetic behavior include lithium, sodium, potassium, rubidium, and cesium. Some examples of alkaline earth elements that can exhibit paramagnetic behavior include magnesium, calcium, strontium, barium, and radium. Some examples of transition elements that can exhibit paramagnetic behavior include the first row transition elements (e.g., scandium, titanium, vanadium, chromium, manganese, iron, cobalt, nickel, and copper), the second row transition elements (e.g., yttrium, zirconium, niobium, molybdenum, technetium, ruthenium, rhodium, and palladium), and the third row transition elements (e.g., hafnium, tantalum, tungsten, rhenium, osmium, iridium, and platinum). Some examples of main group elements that can exhibit paramagnetic behavior include aluminum, gallium, tin, nitrogen, and oxygen. Some examples of lanthanide elements that can exhibit paramagnetic behavior include lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Some examples of actinide elements that can exhibit paramagnetic behavior include thorium (Th), protactinium (Pa), uranium (U), neptunium (Np), plutonium (Pu), americium (Am), curium (Cm), and californium (Cf).

Some elements are generally diamagnetic, and thus, pure (elemental) forms of these elements are generally not suitable for capture by the HGPMS device described herein. Some of these elements include hydrogen, beryllium, francium, radium, zinc, cadmium, mercury, silver, gold, boron, indium, thallium, carbon, silicon, germanium, lead, phosphorus, arsenic, antimony, bismuth, sulfur, selenium, tellurium, polonium, and the noble gases (e.g., helium, neon, argon, krypton, xenon, and radon). However, any of the foregoing elements may, depending on their state and surrounding environment, exhibit some level of paramagnetism. Moreover, the paramagnetic particles considered herein may or may not include one or more elements that are generally diamagnetic, wherein the paramagnetism may emanate from other elements that are paramagnetic or may emanate from low levels of paramagnetism from elements normally considered diamagnetic.

The method for capturing paramagnetic particles may be extended to solid samples if paramagnetic particles in the solid sample are first transferred into a gaseous or liquid medium. Methods for transferring material from a solid sample into a liquid or gas are well known in the art. For example, a soil sample can undergo extraction with a liquid, or a solid sample can be heated in the presence of a gas to transfer volatiles into the gas. The liquid extract or the gas (which may also be a volatilized or atomized form of a liquid extract) can then be processed through the HGPMS device to capture paramagnetic particles that may be present in the liquid extract or gas. Thus, the particle capturing method described herein can have a variety of applications, including air, water, and/or ground (e.g., soil) testing, monitoring, or environmental remediation. The collection efficiency is preferably at least or above 50%, 60%, 70%, 80%, 90%, 95%, 98%, 99%, or even 100%.

After the particles have been captured, the captured particles may either be disposed of or stored (particularly in the case where the sole object is to remove harmful or contaminant particles), or subjected to analysis, depending on the aim of the capturing process. In some embodiments, the porous filling material is cleansed of captured particles and the cleansed porous filling material re-used to process a new sample. To cleanse the porous filling material, the porous filling material may be treated with a solvent and/or heated by processes well known in the art. In some embodiments, the porous filling material, after use, is disposed of or stored away and replaced with fresh porous filling material.

Examples have been set forth below for the purpose of illustration and to describe certain specific embodiments of the invention. However, the scope of this invention is not to be in any way limited by the examples set forth herein.

EXAMPLES

Configuration of the High-Gradient Permanent Magnet System

FIG. 1 shows the arrangement of permanent magnets used in the HGPMS device under study in this experiment. As shown, the HGPMS device under study contains a linear arrangement of four permanent magnets with three pairs of like poles facing each other, each pair of like poles separated by a ferromagnetic separator. The magnetic assembly was enclosed in a stainless steel cylindrical casing, 0.159 cm thick, 15.24 cm (6 inches) long, and 2.54 cm outer diameter. Both ends of the casing were capped off with end caps, with each end cap having a 0.636 cm ID sampling tube at its center. The spacing between the magnets and casing was filled with a stainless steel wool pad that measured 10.16 cm in length (in the flow direction) and 10.16 cm in width (in the cross-flow direction). The wool fibers were approximately 31 μm in diameter, and the wool fiber had a porosity of approximately 0.95.

The location of highest magnetic gradient occurs at the position where two like poles meet. A Hall probe was used for measuring the magnetic field strength at a distance 0.16 cm above the wool surface throughout the length of the wool pad. The Hall probe used is a three-axis magnetometer with a measurement range of $10^{-9}$ to 20 T (direct current to 1 kHz, ±1% accuracy). It simultaneously measures all three axes of the magnetic field.

At both ends of the HGPMS system, the field strength is at its lowest point, about 0.02 T. The magnetic field strength rapidly increases along the magnetic gradient (see FIG. 3), 2× for magnet B1 and 3× for magnet B52. B1 and B52 differ in magnetic field profiles, as further provided in Table 1 below. Table 1 (below) shows the statistical magnetic profiles of the magnets B1 and B52 with and without the wool fiber, designated as "SSW" and "No SSW" (NSSW), respectively. Averaged across the effective length of an HGPMS collector (1.25 cm to 4.75 cm from one end, i.e., from the edge of the first S—S pair), a value of 0.074 T for B1 was obtained with the stainless steel wool, and 0.064 T was obtained for the same magnet without wool; the B52 magnet showed 0.1 T with the stainless steel wool and 0.097 T without the stainless steel wool.

Figure 2:
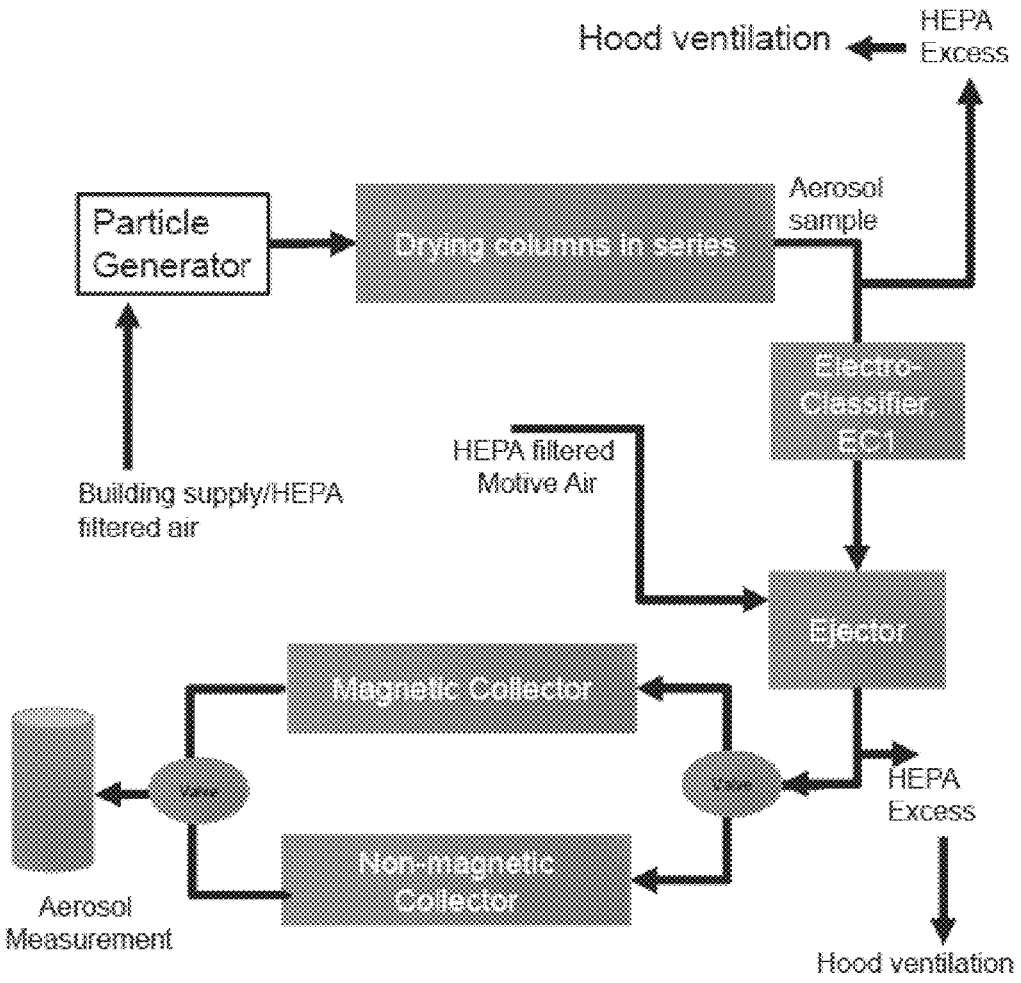
FIG. 2. Diagram showing an experimental setup for generating paramagnetic particles and collecting them on a HGPMS device.
Figure 3:
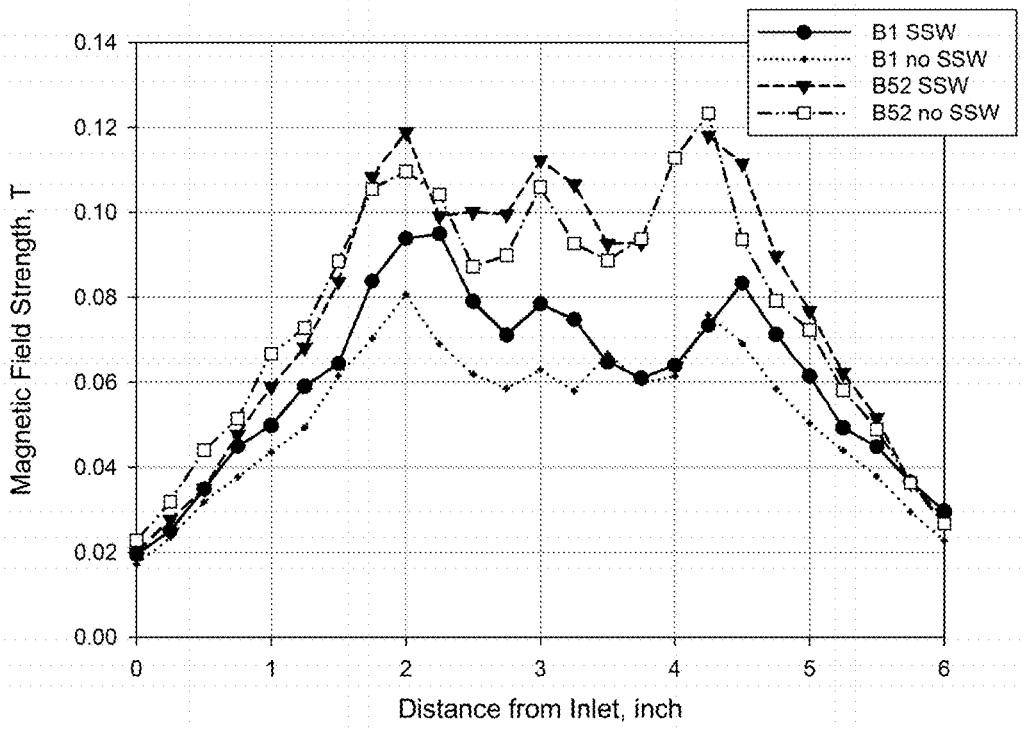
FIG. 3. Graph showing magnetic field strength profiles of two permanent magnets labeled as B1 and B52 as a function of distance (length) from one end (i.e., distance=0) of the linear arrangement of magnets shown in FIG. 2 to the other end (i.e., 6 inches or 15.24 cm) of the linear arrangement of magnets. The designation "SSW" indicates "stainless steel wool," while the designation "No SSW" ("NSSW") indicates "no stainless steel wool".

The graph in FIG. 3 shows the magnetic field strength profiles of the two permanent magnets (B1 and B52) as a function of distance (length) from one end (i.e., distance=0) of the linear arrangement of magnets shown in FIG. 2 to the other end (i.e., 6 inches or 15.24 cm) of the linear arrangement of magnets. The designation "SSW" indicates "stainless steel wool," while the designation "No SSW" ("NSSW") indicates "no stainless steel wool". As shown by the magnetic field strength profile vs. distance from inlet (over the length of the linear assembly of four magnets) in FIG. 3, the field reaches its first maximum at the point where two like poles meet. Thus, three maxima were observed, one for each of the two SS pairs and one for the N—N pair.

TABLE 1

Magnetic measurements (in T) of the two permanent magnets

| | Field | Range | Min | Max | Median | Average |
|---|---|---|---|---|---|---|
| B1 SSW | B | 0.036 | 0.059 | 0.095 | 0.073 | 0.074 |
| | Bx | 0.106 | −0.023 | 0.083 | 0.011 | 0.010 |
| | By | 0.248 | −0.187 | 0.061 | 0.017 | −0.006 |
| | Bz | 0.160 | −0.089 | 0.070 | −0.037 | −0.021 |
| B1 No SSW | B | 0.031 | 0.049 | 0.081 | 0.062 | 0.064 |
| | Bx | 0.010 | −0.006 | 0.004 | 0.001 | 0.000 |
| | By | 0.118 | −0.061 | 0.057 | −0.005 | 0.002 |
| | Bz | 0.142 | −0.079 | 0.062 | −0.025 | −0.019 |
| B52 SSW | B | 0.051 | 0.068 | 0.119 | 0.100 | 0.100 |
| | Bx | 0.064 | −0.039 | 0.025 | −0.007 | −0.006 |
| | By | 0.191 | −0.090 | 0.100 | 0.018 | 0.004 |
| | Bz | 0.261 | −0.146 | 0.115 | 0.031 | 0.017 |

TABLE 1-continued

| Magnetic measurements (in T) of the two permanent magnets | | | | | | |
|---|---|---|---|---|---|---|
| | Field | Range | Min | Max | Median | Average |
| B52 No SSW | B | 0.051 | 0.073 | 0.123 | 0.094 | 0.097 |
| | Bx | 0.010 | −0.007 | 0.004 | −0.001 | −0.001 |
| | By | 0.175 | −0.088 | 0.087 | −0.020 | −0.002 |
| | Bz | 0.228 | −0.106 | 0.122 | 0.044 | 0.029 |

*SSW: stainless steel wool

Materials and Methods

The following three particle compositions were tested as aerosols: NaCl, CuO, and $Fe_3O_4$. The rationale for choosing these three types of particles is as follows. Sodium chloride (NaCl) is a chemical component ubiquitously found in ambient particles among many others; NaCl is particularly enriched in sea-spray aerosol particles. More importantly for this work, pure NaCl particles are weakly diamagnetic, meaning that they are not expected to be attracted by a magnetic field. Thus, they serve as a convenient negative control for the tests. In other words, the NaCl results should represent the filtering capacity of the HGPMS system under study as configured but without the influence of the permanent magnets. Iron oxide ($Fe_3O_4$) particles, which are ferromagnetic, should yield information indicative of the ability of the HGPMS to filter ferromagnetic particles. The magnetic susceptibility of copper oxide (CuO) is between that of NaCl and $Fe_3O_4$ particles. Thus, the three species being tested represent an aerosol population of various magnetic susceptibilities, like that of an ambient aerosol.

The NaCl aerosol was prepared by dissolving 100 mg of analytical grade NaCl salt in 1.0 L of water treated in a Nanopure® system (18.2 MΩ-cm, with D7350 0.2 μm fiber filter) to make a stock concentration of 0.01% w/v. The salt solution was then atomized by an atomizer operated at 26 psig from building-supplied air passed through a high-efficiency particulate air (HEPA) filter. The generated particles passed through a two-stage diffusion dryer before being charge-neutralized by a Kr-85 source. The relative humidity in the gas stream, monitored by an Omega® digital thermo-hygrometer was less than 7% at the end of the second stage.

FIG. 2 shows the experimental setup used for the generation of NaCl particles. As shown, the broad-band aerosol generated by the atomizer was sent to a size-selection section to produce single-size particles. Single-size particles were selected by operating an electrical classifier (EC1, TSI® model 3080) using a differential mobility analyzer (DMA) (TSI® model 3085 or 3081, depending on experiment) at a fixed voltage. An ejector (AirVac model AVL300) was used to extract monodisperse particles from the EC at 1 LPM and to add HEPA-filtered air to produce total air flows at the desired flow rates (3 and 5 LPM).

The $Fe_3O_4$ particles were in a hematite suspension that was obtained from microbial conversion of iron hydroxide ($Fe(OH)_2$). The stock solution was diluted 1000× to produce a working $Fe_3O_4$ particle suspension. The suspension was then sonicated by a pen-style ultrasonicator (tip diameter=2.87 mm) for 10 minutes at half the maximum power and frequency before aerosol was generated by a TSI® 3076 constant output atomizer. The lower portion of the bottle holding the prepared iron oxide suspension was submerged in an ultrasonic bath to prevent particle coagulation throughout the experiment. Selection of a single particle size was accomplished by using the DMA operated at a fixed voltage in an operation similar to that described for NaCl particles.

The CuO particles were produced on demand by using a technique based on the evaporation-condensation principle. The thermal decomposition chemistry of $Cu(NO_3)_2.3H_2O$ is well understood. At 499K (226° C.), the stability of this compound dropped substantially. Initially, the compound was dehydrating as the temperature approached the range of 100° C. to 120° C. Then the dehydrated molecules escaped the droplet phase into the vapor phase to go through vapor-phase decomposition. CuO formed at 530K (257° C.) by the following reaction:

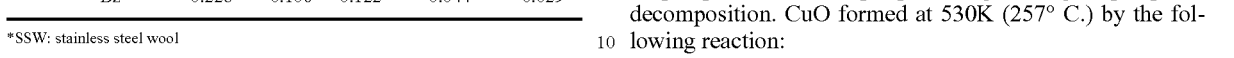

$$Cu(NO_3)_2.3H_2O \rightarrow CuO+2NO_2+3H_2O+0.5O_2$$

CuO particles were collected by a homemade electrostatic precipitator on transmission electron microscope (TEM) grids for microscopic observation. As the furnace temperature increased, particles were sintered, forming solid bridges at the necks among agglomerated particles and turning into spheroids. Because the particles were deposited on the copper portion of a standard TEM grid, imaging was performed with the microscope operating in SEM mode. The size of particles displayed is consistent with that expected during the testing.

Description of Test Conditions

The test conditions reported here include three particle types, three wind speeds or air flow rates, two strengths of permanent magnets, and several particle sizes. The magnetic susceptibility of the bulk materials of these three types of particles are $-14\times10^6$, $>7178\times10^6$, and $242\times10^6$ for NaCl, $Fe_3O_4$, and CuO, respectively. Air flow rates were selected to represent the low wind speed conditions anticipated in sample-collection applications. The air flow rates chosen for the tests (3 and 5 LPM) correspond, respectively, to wind speeds through the HGPMS collector of 7.6 and 12.6 $cm\cdot s^{-1}$.

The tests were performed one particle size at a time by using the DMA as particle size selector. The monodisperse particle size of the test aerosol was in the range of a few nanometers to approximately 200 nm. All the tests were conducted at room temperature and at ambient atmospheric pressure.

Results and Discussion

Figure 4:
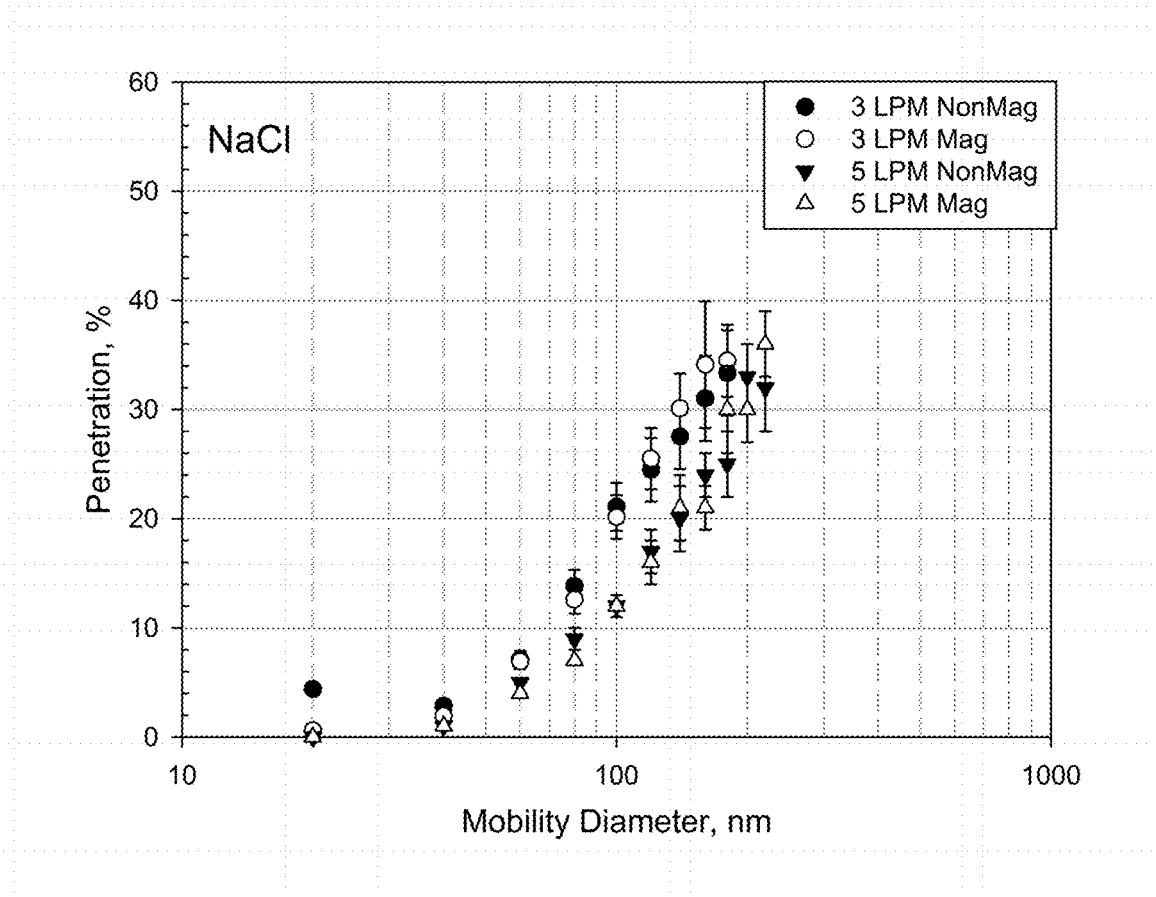
FIG. 4. Graph showing fraction penetrated (in %) vs. mobility diameter test results for NaCl particles at 3 and 5 LPM flow rates under magnetic conditions provided by the HGPMS device depicted in FIG. 2 (i.e., "Mag" condition) or under non-magnetic (i.e., "NonMag") conditions, and at a flow rate of either 3 or 5 LPM. The error bar represents the range of measurement data for each particle size.

Test Results for NaCl Particles:

The graph in FIG. 4 shows the fraction of particles penetrated (in %) vs. mobility diameter test results for NaCl particles at 3 and 5 LPM flow rates under magnetic conditions provided by the HGPMS device depicted in FIG. 2 (i.e., "Mag" condition) or under non-magnetic (i.e., "NonMag") conditions, and at a wind speed of either 7.6 and 12.6 $cm/s^{-1}$ (air flows of 3 and 5 LPM). The penetration in percentage is calculated as 100 times the ratio of outlet particle concentration to the inlet particle concentration. Each of the bars represents five replicated measurements. The data in FIG. 4 show that magnetic force has no impact on the collection efficiency for NaCl (collection efficiency=1−penetration efficiency). Under non-magnetic condition (see the solid markers), higher penetration was found at lower wind speed for a given particle size. As the flow rate (or wind speed) increased from 3 LPM (7.6 cm $s^{-1}$) to 5 LPM (12.6 cm $s^{-1}$), the penetration decreased by only a few percentage points, and the collection efficiency increased as a result. The flow rate dependence holds throughout the entire particle size range in this study. A similar conclusion can be drawn for 1 and 10 LPM flow rates, for which the data are not shown. Under magnetic condition (see the empty, i.e., "non-solid" markers), similar results were observed as under non-magnetic condition. The similarity between magnetic and non-magnetic conditions was expected since NaCl particles are weakly responsive to a magnetic force. For a given wind speed or flow rate, the collection efficiency ranged from 60% for particles ranging in size from 100 to 120 nm to virtually 100% for particles ranging in size from 20 to 30 nm. Smaller particles in this size range are effectively collected by a diffusion mechanism.

The pattern of penetration curves for CuO and $Fe_3O_4$ particles are similar to that shown in FIG. 4 for NaCl, so the results are not elaborated here. Similar patterns observed for these two particles do not provide additional information regarding the magnetic effect on particle collection. In summary, the penetration of CuO and $Fe_3O_4$ particles also increased as the particle size increased from 20 to 200 nm, and also increased as the flow speed increased from 3 to 5 LPM. The difference, however, is that a much lower penetration efficiency for these two types of particles was observed than for NaCl, which can be attributed primarily to the higher paramagnetic abilities of the CuO and $Fe_3O_4$ particles. The following section presents a comparison of the efficiency curves for all three particle types.

Figure 5:
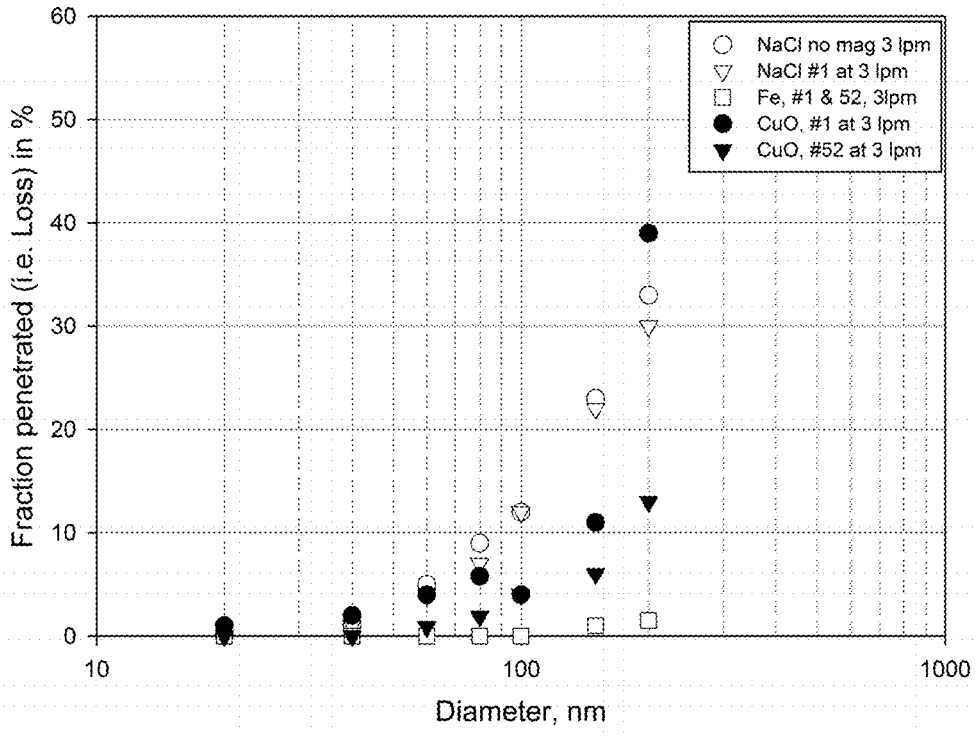
FIG. 5. Graph showing fraction penetrated (in %) vs. mobility diameter test results for all tested particles, wherein "#1" and "#52" refer to the two permanent magnets used.

Combined Test Results at 3 LPM (7.6 $cm \cdot s^{-1}$):

When all the particle data taken at the 3 LPM flow rate for the three sample types were pooled together, as shown in FIG. 5, a general pattern was observed that penetration follows the magnitude of magnetic susceptibility. More specifically, FIG. 5 shows that, given the same particle size, the penetration was highest for NaCl particles, then CuO, and then $Fe_3O_4$. Magnetic force, which was found to have little effect on the collection of NaCl, had a significant effect on the collection of CuO (a paramagnetic particle) and $Fe_3O_4$ (a ferromagnetic particle). The higher the magnetic susceptibility, the greater the collection by the HGPMS collector. For example, at a given wind flow rate, the enhancement in collection efficiency by the magnetic mechanism increased from 60% to close to 100% (~30% increase) for the 120 nm particles, which have the highest magnetic susceptibility among the three. The enhancement diminished or was not as significant for 60 nm or smaller particles. Similar patterns were found at other flow rates tested and not repeated here. The use of HGPMS appears to render the collection efficiency of ferromagnetic particles virtually 100%. Even for the CuO particles, which are only moderately paramagnetic, the collection efficiency was 90% or higher for the size of particles tested.

The tests were performed using single-chemical particles. However, environmental aerosol particles, such as those found in ambient air, indoor air, or the workplace, are generally internally mixed, meaning that each one of them could contain ferromagnetic or paramagnetic components along with other components. This elemental mixing could enhance the overall effective magnetic properties of ambient aerosols. Therefore, the collection efficiency of environmental particles as a function of particle size could be higher than those reported here for single-component particles. Thus, the HGPMS device described herein could be effective for collecting particles in a variety of diverse environments.

In summary, the above results demonstrate the efficient collection of airborne particles by a device in which permanent magnets are arranged in a high-gradient permanent magnetic separation (HGPMS) configuration. Three aerosol particles of different magnetic susceptibilities (diamagnetic NaCl, paramagnetic CuO, and ferromagnetic $Fe_3O_4$) were generated in the electrical mobility size range of 10 to 200 nm and were used to study particulate collection by an HGPMS device. One HGPMS matrix element, made of stainless steel wool, was used in the device configuration. Three flow rates were selected to simulate different environmental wind speeds of interest. Magnetic force was found to exhibit an insignificant effect on the separation of NaCl particles, even in the HGPMS configuration. Diffusion was the major mechanism in the removal of the NaCl particles; however, for CuO or $Fe_3O_4$ particles, diffusion was insignificant under the influence of a high-gradient magnetic field. The HGPMS showed high-performance collection (>99%) on CuO and $Fe_3O_4$ particles for particle sizes greater than or equal to 60 nm. The influence of the magnetic force on removal of particles in a gas stream weakens as the wind speed increases.

While there have been shown and described what are at present considered the preferred embodiments of the invention, those skilled in the art may make various changes and modifications which remain within the scope of the invention defined by the appended claims.

What is claimed is:

1. A high-gradient permanent magnet apparatus for capturing paramagnetic particles, the apparatus comprising:
- (i) at least two permanent magnets positioned with like poles facing each other;
- (ii) a ferromagnetic spacer separating the like poles; and
- (iii) a magnetizable porous filling material at least partially surrounding the at least two permanent magnets, wherein said porous filling material is sufficiently porous to permit the flow of a gas or a liquid.

2. The permanent magnetic apparatus of claim 1, further comprising:
- (iv) a casing enclosing the elements (i), (ii), and (iii), wherein said casing contains an entry port and an exit port for the entry and exit, respectively, of a gas or liquid sample.

3. The permanent magnetic apparatus of claim 1, comprising:
- (i) at least three permanent magnets positioned with like poles facing each other;
- (ii) a ferromagnetic spacer separating each pair of like poles; and
- (iii) a magnetizable porous filling material in close proximity to the at least three permanent magnets.

4. The permanent magnetic apparatus of claim 1, wherein the at least two permanent magnets are in a linear arrangement.

5. The permanent magnetic apparatus of claim 1, wherein the permanent magnets have a composition comprising at least one element selected from iron, cobalt, nickel, and rare earth elements.

6. The permanent magnetic apparatus of claim 5, wherein at least one of the permanent magnets has a magnetite composition.

7. The permanent magnetic apparatus of claim 5, wherein at least one of the permanent magnets has a rare earth composition.

8. The permanent magnetic apparatus of claim 7, wherein the rare earth composition is samarium-cobalt or neodymium-iron-boron.

9. The permanent magnetic apparatus of claim 1, wherein the ferromagnetic separator is iron-based.

10. The permanent magnetic apparatus of claim 1, wherein the magnetizable porous filling material is steel wool.

11. A method for capturing paramagnetic particles, the method comprising contacting a gas or liquid sample containing said paramagnetic particles with a high-gradient permanent magnet apparatus comprising:
- (i) at least two permanent magnets positioned with like poles facing each other;
- (ii) a ferromagnetic spacer separating the like poles; and
- (iii) a magnetizable porous filling material at least partially surrounding the at least two permanent magnets, wherein said porous filling material is sufficiently porous to permit the flow of a gas or a liquid;

wherein, during said contacting step, the gas or liquid sample contacts and flows through the magnetizable porous filling material of said high-gradient permanent magnet apparatus, and at least a portion of said paramagnetic particles in said gas or liquid sample is captured on said magnetizable porous filling material.

12. The method of claim 11, wherein the permanent magnetic apparatus further comprises:

(iv) a casing enclosing the elements (i), (ii), and (iii), wherein said casing contains an entry port and an exit port for the entry and exit, respectively, of the gas or liquid sample.

13. The method of claim 11, wherein the permanent magnetic apparatus comprises:

(i) at least three permanent magnets positioned with like poles facing each other;

(ii) a ferromagnetic spacer separating each pair of like poles; and (iii) a magnetizable porous filling material in close proximity to the at least three permanent magnets.

14. The method of claim 11, wherein the at least two permanent magnets are in a linear arrangement.

15. The method of claim 11, wherein the permanent magnets have a composition comprising at least one element selected from iron, cobalt, nickel, and rare earth elements.

16. The method of claim 15, wherein at least one of the permanent magnets has a magnetite composition.

17. The method of claim 15, wherein at least one of the permanent magnets has a rare earth composition.

18. The method of claim 17, wherein the rare earth composition is samarium-cobalt or neodymium-iron-boron.

19. The method of claim 11, wherein the ferromagnetic separator is iron-based.

20. The method of claim 11, wherein the magnetizable porous filling material is steel wool.

21. The method of claim 11, wherein the paramagnetic particles captured on said magnetizable porous filling material have a size of up to about 200 nm.

22. The method of claim 11, wherein at least a portion of the paramagnetic particles captured on said magnetizable porous filling material have a size in a range of 10 nm to 120 nm.

23. The method of claim 11, wherein at least a portion of the paramagnetic particles contain one or more elements selected from transition metal, lanthanide, and actinide elements.

24. The method of claim 11, wherein at least a portion of the paramagnetic particles contain an element selected from lanthanide and actinide elements.

25. The method of claim 11, wherein the gas or liquid sample is contacted with the high-gradient permanent magnet apparatus in a passive sampling mode wherein passive flow of the gas or liquid sample is relied upon for contacting the gas or liquid sample with the high-gradient permanent magnet apparatus.

26. The method of claim 11, wherein the gas or liquid sample is contacted with the high-gradient permanent magnet apparatus in an active sampling mode wherein active flowing means for directing said gas or liquid sample to the high-gradient permanent magnet apparatus is employed.

* * * * *